US008991810B2

(12) United States Patent
Heinz

(10) Patent No.: US 8,991,810 B2
(45) Date of Patent: Mar. 31, 2015

(54) STACKER

(75) Inventor: Wilhelm Heinz, Grafenberg (DE)

(73) Assignee: Kugler-Womako GmbH, Nuertingen (DE)

( * ) Notice: Subject to any disclaimer, the term of this patent is extended or adjusted under 35 U.S.C. 154(b) by 0 days.

(21) Appl. No.: 13/435,495

(22) Filed: Mar. 30, 2012

(65) Prior Publication Data

US 2012/0274018 A1 Nov. 1, 2012

(30) Foreign Application Priority Data

Mar. 31, 2011 (DE) ..... 10 2011 006 482

(51) Int. Cl.

| | |
|---|---|
| ***B65H 83/00*** | (2006.01) |
| ***B65H 31/10*** | (2006.01) |
| ***B65H 31/30*** | (2006.01) |
| ***B65H 31/20*** | (2006.01) |
| ***B65H 31/32*** | (2006.01) |

(52) U.S. Cl.

CPC ..... *B65H 31/10* (2013.01); *B65H 31/3045* (2013.01); *B65H 31/20* (2013.01); *B65H 31/32* (2013.01); *B65H 2405/1116* (2013.01); *B65H 2511/10* (2013.01)

USPC ..... 271/3.01; 414/790

(58) Field of Classification Search

CPC ..... B65H 2701/1912; B65H 83/025; B65H 31/34; B65H 31/32; B65H 57/303; B65H 31/30; B65H 2301/4223; B65H 33/16; B65H 29/66; G03G 15/60; G03G 2215/00337; G03B 27/6264; B65G 57/00; B65G 57/302; B65G 61/00

USPC ..... 271/3.01, 3.04, 3.13, 3.02, 207, 213; 414/790, 790.1, 790.2, 790.4, 788.9, 414/788.1, 789.9

See application file for complete search history.

(56) References Cited

U.S. PATENT DOCUMENTS

| | | | | |
|---|---|---|---|---|
| 4,249,844 | A * | 2/1981 | Lampe et al. | 414/790 |
| 4,400,124 | A * | 8/1983 | Greller | 414/790.2 |
| 4,436,472 | A * | 3/1984 | Kunzmann | 414/790.8 |
| 5,425,565 | A * | 6/1995 | Rogovein et al. | 294/119.1 |
| 6,679,491 | B2 * | 1/2004 | Luebben et al. | 271/150 |
| 7,866,936 | B2 * | 1/2011 | Schuck et al. | 414/790 |
| 2010/0195080 | A1 * | 8/2010 | Compen et al. | 355/72 |

FOREIGN PATENT DOCUMENTS

| | | | |
|---|---|---|---|
| JP | 58-135053 | * | 8/1983 |
| JP | 2-100924 | * | 4/1990 |

* cited by examiner

*Primary Examiner* — Thomas Morrison

(74) *Attorney, Agent, or Firm* — Greenblum & Bernstein, P.L.C.

(57) ABSTRACT

A stacker is described, in particular in an installation of the paper processing industry, for forming a stack of several flat parts to be fed in a transport direction, in particular film sheets or paper sheets, with a stack forming area and a support device for supporting the stack to be formed from the flat parts in the stack forming area. The special nature of the invention lies in that the support device has a plurality of discrete support elements that are at least arranged one behind the other seen in the transport direction of the flat parts and are supported in a moveable manner between a lower position and an upper position at an angle to the transport direction of the flat parts, preferably approximately at right angles to the transport direction A of the flat parts and/or approximately vertically.

20 Claims, 6 Drawing Sheets

STACKER

CROSS-REFERENCE TO RELATED APPLICATIONS

The present application claims priority under 35 U.S.C. §119 of German Patent Application No. 10 2011 006 482, filed on Mar. 31, 2011, the disclosure of which is expressly incorporated by reference herein in its entirety.

BACKGROUND OF THE INVENTION

1. Field of the Invention

The invention relates to a stacker, in particular in an installation of the paper processing industry, for forming a stack of several flat parts to be fed in a transport direction, in particular film sheets or paper sheets, with a stack forming area and a support device for supporting the stack to be formed from the flat parts in the stack forming area.

2. Discussion of Background Information

In the case of conventional devices of the type referenced at the outset, the paper sheets produced from a paper web by cutting longitudinally and transversely are collected in format-dependent collection boxes with a smooth essentially continuous base, for example, of sheet metal. Therefore in the prior art the individual collection boxes, which are necessary there for each individual deposit, previously have been replaced accordingly for different formats. This results in a relatively large space requirement for the different collection boxes; moreover the replacement of the collection boxes causes an increased work expenditure.

SUMMARY OF THE INVENTION

An object of the present invention is to improve a device of the type mentioned at the outset in that the format adjustment can be carried out with less expenditure.

This object is attained by a stacker, in particular in an installation of the paper processing industry, for forming a stack from several flat parts to be fed in a transport direction, in particular film sheets or paper sheets, with a stack forming area and a support device for supporting the stack to be formed of the flat parts in the stack forming area, characterized in that the support device has a plurality of discrete support elements that are at least arranged one behind the other seen in the transport direction of the flat parts and are supported in a moveable manner between a lower position and an upper position at an angle compared to the transport direction of the flat parts, preferably approximately at right angles to the transport direction of the flat parts and/or approximately vertically.

With the aid of the invention the smooth and essentially continuous collection box base used in the prior art is replaced by support elements that can be retracted and extended, which instead of the previous collection box base now carry the sheets or the stacks to be formed from the sheets and thus take on the function of a support device for the support or deposit of the sheets or of the stack. This means that not only can the stacking area be adapted to the height of the stack to be formed from the sheets, but also the base of the stack forming area becomes flexible in format, since only the actually required support elements have to be used for the support of the stack, which is an advantage in particular with the use of lateral stops. A further advantage of the invention lies in that with the removal of the finished stack out of the stack forming area, the gap forming behind this stack is filled again by extending the support elements into their upper end position.

Thus the first sheets of the next stack to be newly formed therefrom are supported and remain largely parallel to the transport plane or the collection plane. Accordingly, with the aid of the invention an essentially independently adjusting stack deposit is proposed which optionally can also be embodied in a multiple use manner and has a support device per use or per individual collection box, which support device is formed by a plurality of the support elements supported in a moveable manner between an upper and a lower end position.

Preferred embodiments and further developments of the invention are given in the dependent claims.

Preferably, at least some of the support elements have a rod-shaped or pin-shaped body and are supported in a moveable manner essentially in the direction of the longitudinal extension of their rod-shaped or pin-shaped body.

Expediently, at least some of the support elements have a preferably flat head that is wider compared to another section, with which head these support elements can be brought in particular into flat bearing against the underside of the lowest flat part of a stack.

Preferably, the support elements can be moved between an upper position and a lower position and the distance between the upper position and the lower position is sized or can be adjusted depending on a fixed maximum height of the stack to be formed from the flat parts.

A particularly preferred embodiment of the invention with a removal device for carrying away a finished stack by movement, for instance, in the direction of a plane spanned by the flat parts from the stack forming area is characterized in that the support elements are moveably supported such that during the removal of the stack they fill the gap forming behind the stack by moving into their upper position. This embodiment also shows the advantages of the invention. The first sheets of the new next stack are easily supported on the support elements, which as far as possible are extended again immediately, and thereby also remain largely parallel to the collection plane.

Preferably the support elements are also arranged next to one another, seen in the transport direction of the flat parts, whereby in particular a matrix of support elements can be produced.

Expediently, the support elements can be combined to form groups with regard to their movement. Preferably, a number of support elements can always be moved jointly, which can be selected in particular depending on the respective operating condition, optionally in the transport direction or transversely to the transport direction.

A further preferred embodiment, in which the stack forming area is limited by at least one lateral stop, which is arranged in a correspondingly adjustable manner for a format adjustment, is characterized in that the at least one lateral stop is embodied to hold the support elements located in the region of its respective position in a lower position. The base of the stack forming area is thus flexible in terms of format, since the lateral stops simply cover support elements that are not needed.

At least some of the support elements can be moved with the aid of a preferably electromotively, electromagnetically, pneumatically or hydraulically operated lifting unit. Preferably, this lifting unit should be embodied and/or be controllable such that it lowers the support elements during the formation of the stack such that the top of the stack remains approximately stationary. Since the top of the continuously growing stack remains essentially in a defined position, a smooth takeover from an upstream conveyor device can be realized.

Alternatively or additionally, at least some of the support elements can be supported in a yielding manner. To this end the support elements, preferably with the aid of a pneumatic device and/or a mechanical spring device, can be resiliently biased in the direction of a transport plane in which the flat parts are fed. The resilient biasing should thereby be sized or adjustable such that during the formation of the stack, the top thereof remains approximately stationary, i.e. essentially in the same, preferably horizontal plane.

The stack forming area can preferably be provided with a base in which the support elements are supported so that they can be moved out of and into this base. A base of this type thus provides a repository for a finished stack in the event that the support elements are completely retracted into the base and lowered.

In a further embodiment, a so-called hold down device can be used, which can be moved from the side located upstream with respect to the transport direction of the flat parts into the stack forming area and is arranged and embodied to hold the support elements located there in a lower position and thus to create space for a flexible format adjustment of a conveyor device located upstream with respect to the transport direction of the flat parts. In a further development of this embodiment, the hold down device has at least one plate-like element that extends at an angle, preferably approximately at a right angle, to the direction of movement of the support elements and/or approximately horizontally, and with its end located downstream with respect to the transport direction of the flat parts is tilted upwards in the direction towards the upper position of the support elements; a type of incline is formed thereby with which the support elements can be brought into contact bearing and then can be pressed downwards due to a continued movement of the hold down device.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
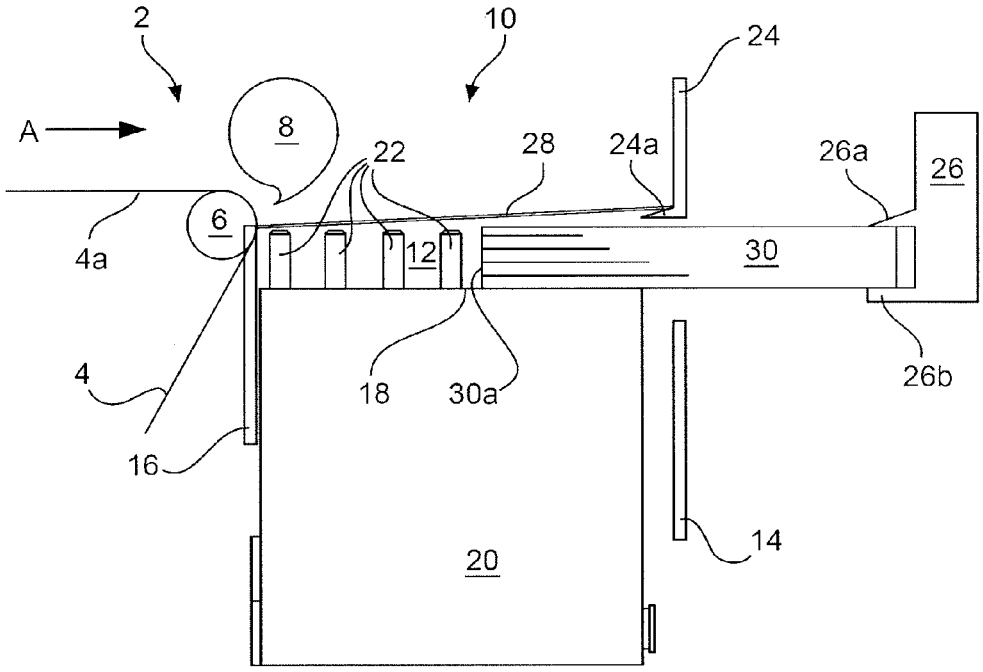
FIG. 1 shows diagrammatically in side view an end region of a paper processing installation with the end section, located downstream, of a conveyor device and a downstream collection station according to a first preferred exemplary embodiment of the invention.
Figure 2:
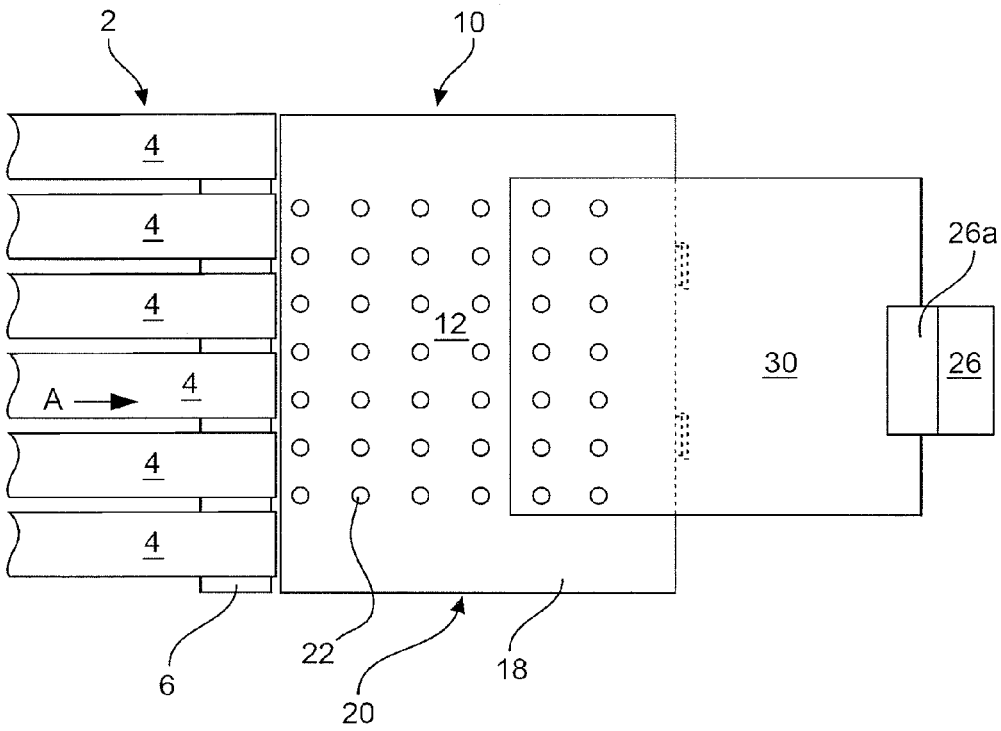
FIG. 2 shows a diagrammatic plan view of the arrangement of FIG. 1.

FIGS. 1 and 2 show diagrammatically by way of example the end region, located downstream in the process direction according to arrow A, of a conveyor device 2 of a paper processing installation, with an endless conveyor belt 4, which is deflected at its downstream end over a deflection roller. Above the deflection roller 6 a so-called beater device 8, which is referred to as a beater for short, is rotatably supported, and the rotation axis thereof, not shown in the figures, runs parallel to the rotation axis of the deflection roller 6. FIG. 2, in which the beater 8 is omitted, indicates that the conveyor device 2 in the exemplary embodiment shown has several conveyor belts 4 lying next to one another, which are jointly deflected via the deflection roller 6. As can be further seen from FIG. 1, the upper strand 4*a* of the conveyor belts 4 forms a plane not shown in the figures, in which the sheets are fed such that that plane can also be described as a transport plane. With the aid of the conveyor belts 4 and of the beater 8 of the conveyor device 2, sheets are conveyed into a collection station 10 located downstream, which is also referred to as a stack forming device or stack deposit. The sheets fed by the conveyor device 2 are thereby transported in the direction of the arrow A, which thus gives not only the process direction but also the transport direction of the sheets. The collection station 10 is likewise part of the paper processing plant and serves as a stack deposit for forming stacks from the sheets fed by the conveyor device 2.

In the mentioned paper processing plant, which otherwise is not shown in the attached drawings, rollers are generally used that are composed of a wound endless sheet web of paper, which for the subsequent processing is unwound from the corresponding roller. The subsequent process steps comprise in a plant of this type a longitudinal and transverse cutting of the sheet web to form sheets of a predetermined size, to which end corresponding longitudinal and transverse cutting stations are provided. The finished sheets are stacked at the end of the processing process, to which end the collection station 10 already previously mentioned is provided. If necessary, the cut sheets can be brought into an overlapping, scaled arrangement on their way to the collection station 10, which can take place, for example, in the conveyor device 2 or to which end alternatively a separate overlapping station can also be provided. If the sheets are to be printed with desired printed images, which in particular is the case when book blocks are to be produced in the installation, a corresponding printing station is to be provided which preferably lies upstream of the longitudinal and transverse cutting stations.

After the formation of the finished stack, which can be so-called clips, reams, book blocks or simple sheet stacks, the stacks are removed from the collection station 10 and fed to a further processing elsewhere. The collection station 10 therefore also has the function of a takeover station.

As can be further seen from FIG. 1, the collection station 10 has a stack forming area 12, which forms a collection box. With a multiple-use application, in which several rows of sheets lying next to one another are formed, the stack forming area 12 has a corresponding number of individual collection boxes lying next to one another, which is not shown in the figures, however. The stack forming area 12 is delimited by a front stop 14 towards the front in the transport direction according to arrow A, which stop is also referred to as a front aligning device. In the exemplary embodiment shown the front stop 14 is composed of a vertically arranged plate-like element, which is arranged in a moveable manner in the vertical direction and thus in an adjustable manner in terms of its vertical height. As FIG. 1 further shows, the stack forming area 12 is delimited by a rear stop 16 at its rear, that is, on its side located downstream with respect to the transport direction according to arrow A. In the exemplary embodiment shown the rear stop 16 is composed of a plate-like element that is vertically aligned and arranged in a stationary manner. Although in the exemplary embodiment shown the upper end of the rear stop 16 lies adjacent to the deflection roller 6 of the conveyor device 2, it is below the transport plane formed by the upper strand 4*a* of the conveyor belt 4, so that the sheets fed by the conveyor device 2 can reach the stack forming area 12 of the collection station 10 beyond the rear stop 16. On its underside, the stack forming area 12 open at the top is delimited by a base 18, which in the exemplary embodiment shown at the same time forms the top of a box-shaped housing 20.

In the housing 20 a plurality of pins 22 are supported, which are aligned vertically and are guided through corresponding openings (not shown) in the base 18 and extend upwards in the direction towards the transport plane spanned by the upper strand 4*a* of the conveyor belt 4. As can be seen in particular from FIG. 2, in the exemplary embodiment shown with respect to the transport direction according to arrow A the pins 22 are arranged one behind the other as well as next to one another in the manner of a matrix essentially arranged over the entire base 18 of the stack forming area 12.

The pins 22 are used to receive the sheets arriving from the conveyor device 2 and thus take over a support function for depositing the sheets to form a stack. The pins 22 can therefore also be referred to as support elements. While the pins 22 shown in the figures are composed only of a rod-shaped or pin-shaped body, it is also alternatively conceivable, for example, to provide the pins with a preferably flat head or ram that is wider compared to the rod-shaped or pin-shaped body, to form a larger flat support for the sheets, which is not shown in the figures, however.

The pins 22 are moveably supported in the vertical direction between an upper end position and a lower end position. The pins 22 are furthest extended in the upper end position. The pins 22 visible in FIG. 1 are located in their upper end position. In contrast, in the lower end position the pins are retracted. In the exemplary embodiments shown in the figures, the pins 22 are in their lower end position with their upper front end or head at the height of and aligned with the base 18 and are thus essentially fully retracted downwards into the housing 20 or have disappeared therein. In particular when the pins 22 are thus moveably supported in the housing 20 such that they are retracted into the housing 20 into a lower position under the base 18 and thus lie under the base 18, the effective lower end position is formed as an alternative by the base 18.

In the exemplary embodiments shown, the collection station 10 further has a separation finger 24, in order, after the formation of a finished stack, to keep the sheets subsequently fed by the conveyor device 2 separate from that stack. To this end the separation finger 24 is arranged on the front side, lying downstream with regard to the transport direction according to arrow A, of the stack forming area 12 above the front stop 14 and is aligned thereto. For the sake of completeness it should be noted that the separation finger 24 is held in a moveable manner on a holder, not shown.

To remove a finished stack, the collection station 10 shown furthermore has a gripper 26, which is arranged downstream of the stack forming area 12 seen in the transport direction according to arrow A. The gripper 26 is also held in a moveable manner on a holder, which is not shown in the figures either.

FIG. 1 shows an operating condition in which a sheet 28 has been conveyed by the conveyor device 2 into the stack forming area 12 of the collection station 10 and bears with its rear trailing section located upstream seen in the transport direction according to arrow A against the fully extended pins 22 and with its leading or front edge located downstream seen in the transport direction according to arrow A is grasped beneath by the finger section 24*a*, aligned essentially in a horizontal manner and extending in the direction of the stack forming area 12, of the separation finger 24. Furthermore, FIG. 1 shows a finished stack 30, which has already been drawn out to a large extent by the gripper 26 from the stack forming area 12 of the collection station 10 and bears only with its upstream section against the base 18. As diagrammatically indicated in FIG. 1, in the exemplary embodiment shown the gripper 26 has an upper jaw 26*a* and a lower jaw 26*b*, between which the upstream edge, seen in the transport direction according to arrow A, of the finished stack 30 is clamped, whereby the gripper 26 grips this edge of the stack 30 and in the exemplary embodiment shown draws it out of the stack forming area 12 of the collection station 10 in the direction according to the transport direction according to arrow A.

In the same area where the stack 30 with its upstream section still bears against the base 18, the pins 22 are fully retracted, which is indicated in FIG. 2 by a diagrammatic dashed representation of the pins in the region of the stack 30. The gap forming behind the back 30*a* of the stack 30, however, is filled by the fully extended pins 22, as FIG. 1 indicates. The fact that the pins 22 in the region of the stack forming area 12 are extended between the stack 30 and the conveyor device 2, is also indicated by the continuous circles in FIG. 2, in which, however, the representation of the sheet 28 (FIG. 1) already located above it has been omitted for greater clarity.

In the exemplary embodiment shown the distance between the upper end position and the lower end position of the pins 22 is sized or adjustable depending on a fixed maximum height of the stack 30 to be formed from the sheets.

Figure 1A:
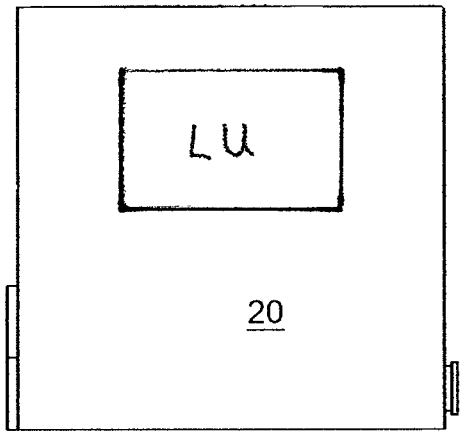
FIG. 1A schematically shows how a lifting unit is arranged within the housing.

For the movement of the pins 22 between their upper end position and their lower end position a lifting unit LU can be provided, which is arranged inside the housing 20 as shown schematically in FIG. 1A. A lifting unit LU of this type can preferably be operated electromotively, electromagnetically, pneumatically or hydraulically in order to extend or lower or to retract the pins 22. The lifting unit LU is preferably controlled by a control device such that during the formation of the stack 30 by constantly fed sheets 28, the pins 22 are lowered such that the top of the gradually growing stack 30 remains as it were in a stationary manner in approximately the same horizontal plane and preferably lies somewhat below the plane spanned by the upper strand 4*a* of the conveyor belt 4. After the formation of the stack 30 has been completed and the pins 22 have thereby been completely retracted into their lower end position, while the stack 30 is drawn out by the gripper 26, the control device should control the lifting unit such that the gap forming behind the stack 30 is immediately filled by a movement of the pins 22 as quickly as possible from their lower end position into the upper end position. This latter measure is particularly advantageous so that the new sheets 28 for the next stack are immediately given support by the pins 22 and thereby come to rest largely parallel—at first still with the action of the separation finger 24. The mentioned control device is preferably likewise accommodated in the housing 20.

The lifting unit and the control device are preferably embodied such that the pins 22 can be adjusted individually or at least individually in rows.

Instead of or in addition to an active yielding bearing of the pins 22 with the aid of the previously described lifting unit, which actively causes an adjustment of the pins 22 in particular by controllable motors, actuators or other control drives, it is also conceivable to provide a yielding support for the pins 22. A passive yielding support of this type can be preferably realized in that the pins 22 are resiliently biased in the direction of their upper end position, and namely preferably with the aid of a pneumatic device and/or a mechanical spring device. Furthermore, similar to the previously described control of the lifting unit, the resilient biasing should also be sized or adjustable such that during the formation of the stack 30, the top thereof remains approximately stationary.

Regardless of whether the yielding bearing is realized actively with the aid of the previously described lifting unit or passively by a resilient biasing, at least for ending the operation, the pins 22 can also move into the lower end position due to their inherent weight, in that the lifting unit or the resilient biasing are deactivated.

During operation, thus when a stack 30 is being built up on the pins 22, although the increasing weight of the stack can be used to lower the pins 22 into their lower end position, for the retraction of the pins 22 a lowering speed should be selected such that during the formation of the stack 30 the top thereof remains approximately stationary in order to ensure a smooth stacking by the continuously fed sheets 28. This means that in the event that the lowering speed is higher than desired, a braking counter force must be generated, whether by a corresponding control of the previously described lifting unit or by a corresponding dimensioning of the resilient biasing.

Figure 3:
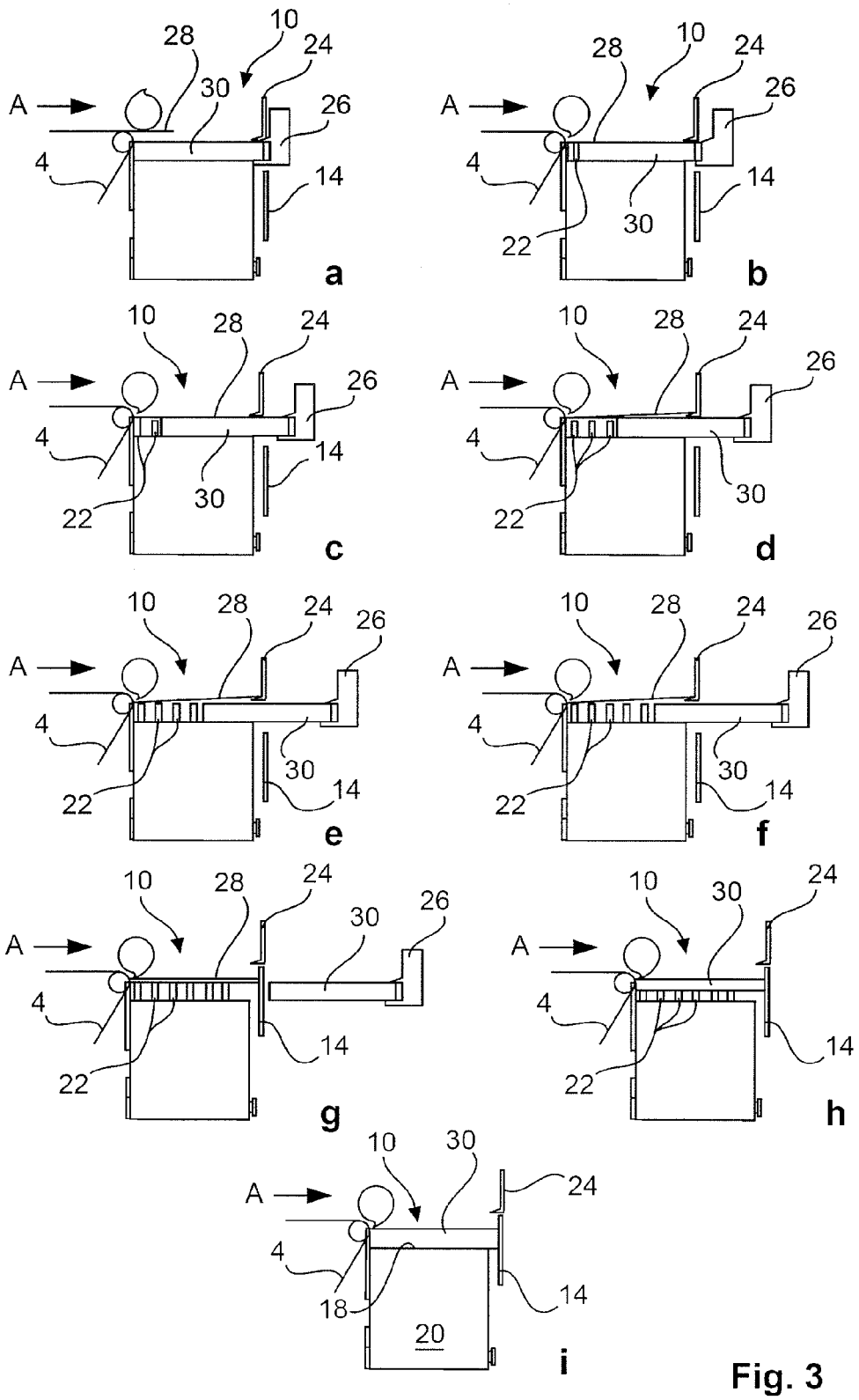
FIG. 3 shows diagrammatically in a reduced-size side view the arrangement of FIG. 1 in nine different operating conditions (a through i)

In FIG. 3 nine different operation states (a) through (i) are shown in the same diagrammatic side view as in FIG. 1 to indicate the function of the previously described arrangement.

FIG. 3*a* shows an operating condition with an already completed stack 30, which is still in the stack forming area of the collection station 10, but its front edge is already grasped by the gripper 26. In order for the gripper 26 to be able to draw the stack 30 out of the stack forming area of the collection station 10, the front stop 14 is moved into a lower position, as FIG. 3*a* likewise indicates. The separation finger 24 has been moved into a lower position just above the stack 30 in order to grasp under a next sheet 28 already delivered by the conveyor belts 4 after it arrives in the stack forming area of the collection station 10, as shown in FIG. 3*b*. FIG. 3*b* thereby further shows that below the sheet 28 now held in the stack forming area of the collection station 10 by the separation finger 24, the finished stack 30 lying below it is slowly drawn out of the stack forming area of the collection station 10 with the aid of the gripper 26 in a direction corresponding to the transport direction according to arrow A.

While the pins are fully refracted and thus are in their lower end position, as long as the finished stack 30 still bears against the base 18 of the stack forming area 12 of the collection station 10, as shown in FIG. 3*a*, while the stack 30 is drawn out by the gripper 26, the gap forming behind the stack 30 is immediately filled by an extension of the pins 22 as quickly as possible into their upper end position, in order to support the new sheet 28 or the new sheets 28 together with the separation finger 24, as FIGS. 3*b* through 3*f* show successively. The representation of FIG. 3*e* thereby corresponds to the representation of FIG. 1.

After the stack 30 has been completely drawn out of the stack forming area of the collection station 10 with the aid of the gripper 26 and thus has been removed and thereby all of the pins 22 have been extended into their upper end position, the support of the new sheets 28 fed in the meantime to form a new stack is now taken over completely by the pins 22. As a result the separation finger 24 is brought out of engagement with the lowest new sheet 28 and is moved into an upper rest position. However, in order that the front alignment function previously taken over by the separation finger 24 to form a straight front of the forming new stack is maintained, the front stop 14 is now moved from its lower position shown in FIGS. 1 and 3*a* through *f* into an upper position and takes over the function of the front aligning device. This operating condition is shown diagrammatically in FIG. 3*g*.

With continuous delivery of new sheets, the stack 30 gradually grows and the pins 22 are gradually lowered accordingly until with the completed stack 30 this bears against the base 18 of the stack forming area 12 of the collection station 10 and the pins 22 are completely retracted and thus have disappeared in the housing 20, as the sequence of the FIGS. 3*g* through 3*i* indicates.

Once the stack 30 is filled, the front stop 14 is moved into its lower rest position and the separation finger 24 into its lower operating position just above the stack 30 and the gripper 26 is brought into engagement with the stack 30 so that now the operating state of FIG. 3*a* has been attained again.

For the operating sequence previously described based on FIG. 3, it is advantageous to combine the pins 22 in rows transversely to the transport direction according to arrow A, so that the pins of each row perform the same extension or lowering movement.

Figure 4:
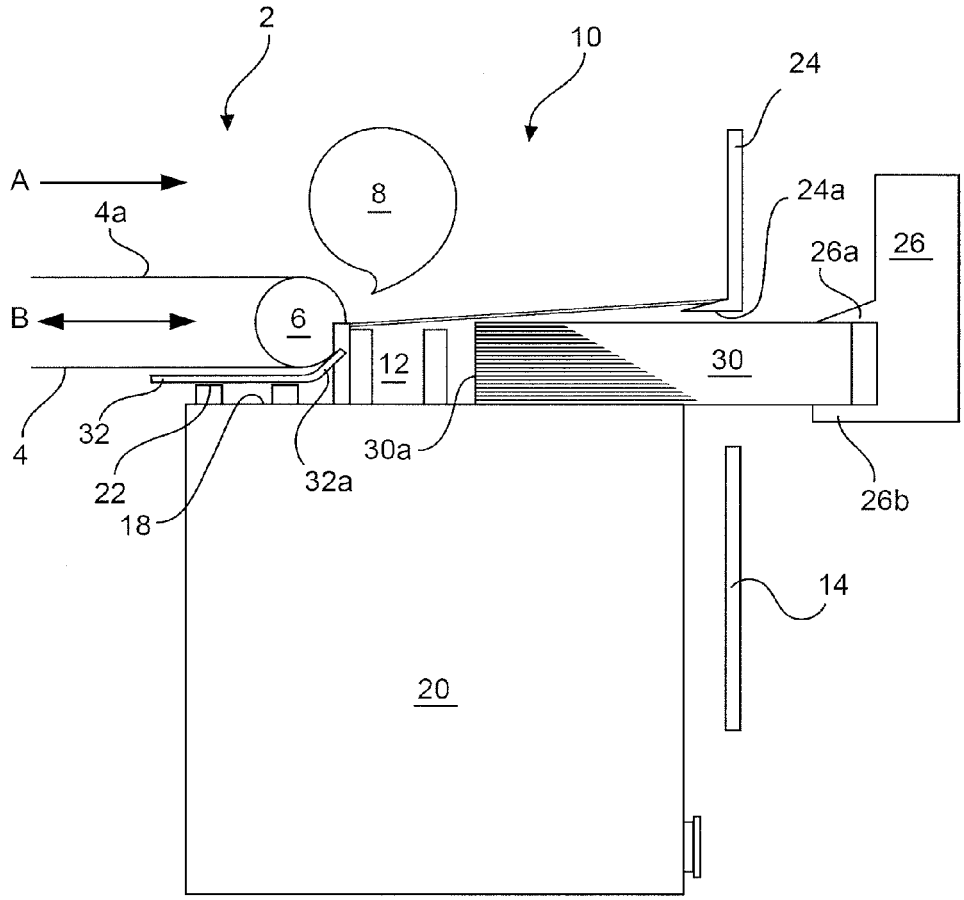
FIG. 4 shows diagrammatically in side view an end region of a paper processing installation with the end section, located downstream, of a conveyor device and a downstream collection station according to a second preferred exemplary embodiment of the invention.

FIG. 4 shows a modified embodiment which is expanded compared to the embodiment shown in FIGS. 1 and 2 by a so-called hold down device 32. This hold down device 32 is arranged in the section of the stack forming area 12 of the collection station 10 located downstream with respect to the transport direction according to arrow A and in the exemplary embodiment shown is composed of a plate-like element lying essentially horizontally, the end 32 thereof, located downstream with respect to the transport direction according to arrow A, is tilted upwards and thus points to the upper position of the pins 22. The hold down device 32 is supported and embodied in a retractable manner from the side of the stack forming area 12 located upstream into the stack forming area 12, to hold the pins 22 located there in a lowered position, as indicated by FIG. 4. The use of a hold down device 32 of this type is advantageous when the conveyor device 2 is provided with a flexible format adjustment, whereby at least the arrangement of the conveyor belts 4, the deflection roller 6 and the beater 8 in essentially the horizontal direction according to double arrow B is reciprocally adjustable parallel to the transport direction of the sheets 28 according to arrow A. FIG. 4 shows a condition in which the arrangement of the conveyor belts 4, the deflection roller 6 and the beater 8 is retracted into the adjacent section, upstream with respect to the transport direction A, of the stack forming area 10 of the collection station 2. So that the pins 22 do not interfere in this section, they must be held in a lowered position there, which is taken over by the hold down device 32, in order to thereby create space for the flexible format adjustment of the conveyor device 2. The end section 32*a* of the hold down device 32 tilted upwards can thereby be embodied such that during the adjustment of the hold down device 32 in the direction according to the transport direction according to arrow A it comes into bearing contact with the pins 22 and presses them downwards.

Since a corresponding adjustment of the hold down device 32 in the direction of the double arrow B is necessary for a format adjustment of the conveyor device 2, it is advisable to provide the hold down device 32 in a stationary manner to the arrangement comprising the conveyor belts 4, the deflection roller 6 and the beater 8. It is thus advisable to form a common structural unit of the conveyor belts 4, the deflection roller 6, the beater 8 and the hold down device 32, the adjustment of which unit in the direction of the double arrow A results not only in an adjustment of the arrangement of the conveyor belts 4, the deflection roller 6 and the beater 8, but also in an adjustment of the hold down device 32 synchronous thereto. In this manner a particularly simple, yet effective adjustment possibility is thus created.

Figure 5:
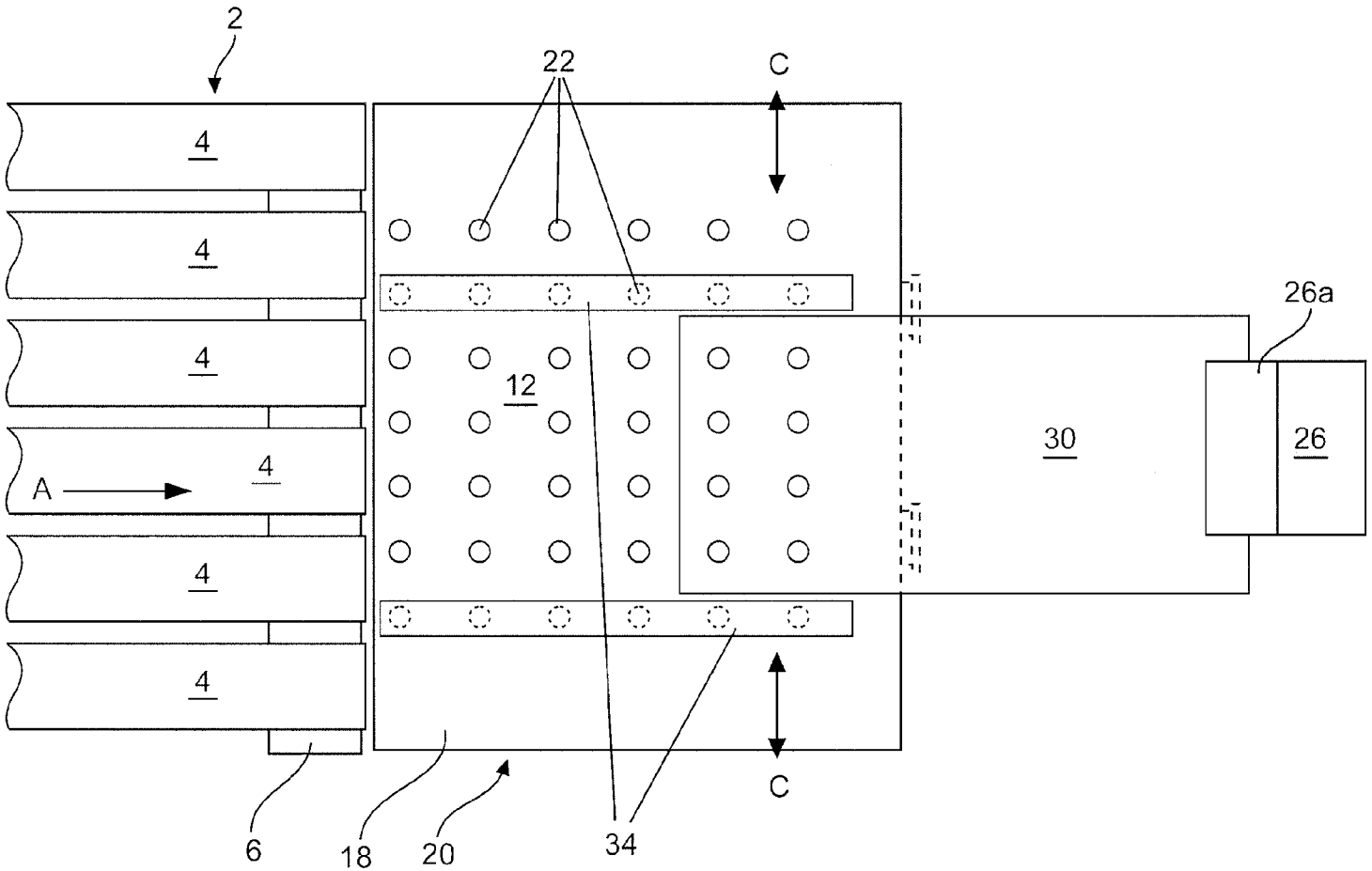
FIG. 5 shows the same plan view as FIG. 2 in addition with a diagrammatic representation of two lateral stops.

FIG. 5 is the same plan view as in FIG. 2, wherein in addition two lateral stops 34 are provided for the lateral format adjustment or width adjustment. These lateral stops 34 form lateral alignment devices and in the exemplary embodiment shown are composed of upright walls or metal sheets. For the format adjustment the lateral stops 34 are arranged in a reciprocally displaceable manner on the base 18 of the stack forming area 12 in the direction of the double arrow C transverse to the transport direction according to arrow A. The underside of the lateral stops 34 is thereby embodied such that they hold pins 22 located in the region of their respective position in their lower position, which is indicated in FIG. 5 by a diagrammatically dashed representation of those pins 22. The base 18 of the stack forming area 12 is thereby flexible in format, since the lateral stops 34 simply cover the pins not needed. In this context it is useful to combine the pins 22 into rows extending in the transport direction according to arrow A, so that the pins 22 of one row jointly perform an extending or lowering movement and in particular can be lowered jointly when a lateral stop 34 is brought into the region of a row of pins 22 of this type.

Preferably, the lateral stops 34 are subjected to vibration movements by drives, not shown, which is advantageous for the formation of straight edges on the stack 30. In this context it is additionally conceivable to also set at least the pins 22 bearing the stack 30 into comparable vibration movements.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A stacker for forming a stack of flat items, said stacker comprising:

a stack forming area arranged downstream of a transport direction and receiving flat items that move along the transport direction from an upstream position;

a removal device structured and arranged to remove a finished stack from the stack forming area;

the removal device being movable along a direction away from the stack fixating area;

a support device structured and arranged to support a lower side of a stack of flat items in the stack forming area and comprising a plurality of discrete support elements arranged at least one behind another when viewed in the transport direction; and the plurality of discrete support elements configured to be moved by a lifting unit and being movable between a lower position and an upper position at an angle to the transport direction and being movable downward as a thickness of the stack increases, wherein, during removal of the finished stack, at least some of the plural discrete support elements are structured and arranged to move to the upper position to fill a gap formed during removal of the finished stack.

2. The stacker of claim 1, wherein the stacker is a paper processing industry stacker, wherein the flat items are paper sheets, and wherein the removal device is movable essentially along a direction of a plane spanned by the stack flat items.

3. The device of claim 1, wherein the plurality of discrete support elements are movable between the lower position and the upper position along a direction that is perpendicular to the transport direction.

4. The device of claim 1, wherein at least some of the plurality of discrete support elements are movable one of:

linearly; and along an essentially vertical direction between the lower position and the upper position.

5. The device of claim 1, wherein at least some of the plurality of support elements are rod-shaped or pin-shaped, have a longitudinal axis, and are movable essentially along a direction of the longitudinal axis.

6. The device of claim 1, wherein the upper position of the plurality of discrete support elements essentially corresponds to a predetermined maximum height of the finished stack and a distance between the upper position and the lower position corresponds to a thickness of the finished stack.

7. The device of claim 1, wherein the plurality of discrete support elements are arranged next to one another when viewed along the transport direction.

8. The device of claim 1, further comprising at least one adjustable lateral stop arranged in the stack forming area and being structured and arranged to hold down some of the plurality of discrete support elements in the lower position.

9. The device of claim 1, wherein the plurality of discrete support elements have lower ends that extend into a support surface of the stack forming area and are capable of being lifted from underneath to the support surface.

10. The device of claim 1, wherein, during a formation of the stack, the plurality of discrete support elements move toward the lower position such that a top of the stack remains approximately stationary.

11. The device of claim 1, wherein at least some of the plurality of support elements comprises upwardly biased support elements.

12. The device of claim 1, wherein the plurality of support elements comprise upwardly biased support elements.

13. The device of claim 1, wherein the stack forming area is arranged on a base and the plurality of discrete supporting elements move up and down relative to the base.

14. The device of claim 1, further comprising a hold down device arranged on an upstream side of the stack forming area and being capable of holding at least some of the plural discrete support elements in the lower position so as to create a conveyor device adjustment space.

15. The device of claim 14, wherein the hold down device comprises at least one plate-shaped element having an end titled upwardly.

16. The device of claim 15, wherein the plate-shaped element extends one of:

essentially along a direction that is perpendicular to a direction of movement of the plurality of discrete support elements; and essentially horizontally.

17. A method of forming a stack using the device of claim 1, the method comprising moving the plurality of discrete support elements downwardly during stack formation so that a top of the stack remains approximately stationary while a thickness of the stack increases.

18. The method of claim 13, wherein the plurality of discrete support elements are pins or rods biased toward the upper position.

19. A sheet stacker comprising:

a stack forming area arranged downstream of a transport direction, receiving sheets that move along the transport direction from an upstream position, and being sized and configured to form a stack;

a plurality of linearly movable discrete support elements arranged in the stack forming area; and the plurality of discrete support elements configured to be moved by a lifting unit and being movable between a lower position and an upper position and having upper ends that support a lower side of the stack, wherein, during formation of the stack, the plural discrete support elements supporting the stack move downwards, wherein, during removal of the stack from the stack forming area, some but not all of the plural discrete support elements move upwards, and wherein, during further removal of the stack from the stack forming area, an additional some but not all of the plural discrete support elements move upwards.

20. A paper sheet stacker comprising:

a stack forming area arranged downstream of a transport direction, receiving paper sheets that move along the transport direction from an upstream position, and being sized and configured to form a stack;

a removal device structured and arranged to remove the stack from the stack forming area;

the removal device being movable along a horizontal or downstream direction away from the stack forming area;

a plurality of linearly movable discrete support elements arranged in the stack forming area;

the plurality of discrete support elements configured to be moved by a lifting unit and being movable between a lower position and an upper position and having upper ends that support a lower side of the stack, wherein, during formation of the stack, the plural discrete support elements supporting the stack move to toward the lower position as a thickness of the stack increases, wherein, during removal of the stack from the stack forming area, at least one set of the plural discrete support elements not covered by the stack moves to the upper position, and wherein, during further removal of the stack from the stack forming area, at least another set of the plural discrete support elements not covered by the stack moves to the upper position.

* * * * *